US009315239B2

(12) United States Patent
Gill et al.

(10) Patent No.: US 9,315,239 B2
(45) Date of Patent: Apr. 19, 2016

(54) LOAD COMPENSATING MOORING HOOKS

(71) Applicants: Keith Gill, Salida, CO (US); Roald T. Lokken, Houston, TX (US)

(72) Inventors: Keith Gill, Salida, CO (US); Roald T. Lokken, Houston, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 0 days.

(21) Appl. No.: 14/360,897

(22) PCT Filed: Jan. 11, 2013

(86) PCT No.: PCT/US2013/021238

§ 371 (c)(1),
(2) Date: May 27, 2014

(87) PCT Pub. No.: WO2013/115958

PCT Pub. Date: Aug. 8, 2013

(65) Prior Publication Data

US 2014/0338581 A1 Nov. 20, 2014

Related U.S. Application Data

(60) Provisional application No. 61/592,928, filed on Jan. 31, 2012.

(51) Int. Cl.

| | |
|---|---|
| ***B63B 21/20*** | (2006.01) |
| ***B63B 21/04*** | (2006.01) |
| ***B63B 21/58*** | (2006.01) |

(52) U.S. Cl.

CPC ..... *B63B 21/20* (2013.01); *B63B 21/04* (2013.01); *B63B 21/58* (2013.01); *B63B 2021/203* (2013.01)

(58) Field of Classification Search

CPC ..... B63B 21/00; B63B 21/04; B63B 21/16; B63B 21/20; B63B 21/56; B63B 21/58; B63B 21/60

USPC ..... 114/230.21, 230.23, 230.3; 294/82.27, 294/82.33

See application file for complete search history.

(56) References Cited

U.S. PATENT DOCUMENTS

| | | | |
|---|---|---|---|
| 3,913,396 | A | 10/1975 | Elliot |
| 4,055,137 | A | 10/1977 | Motai et al. |
| 4,658,748 | A | 4/1987 | Epstein |
| 5,123,374 | A | 6/1992 | McMillan |
| 5,816,182 | A | 10/1998 | Pollack |
| 7,104,213 | B2 | 9/2006 | Reynolds |

(Continued)

FOREIGN PATENT DOCUMENTS

| | | |
|---|---|---|
| GB | 1 576 740 | 10/1980 |
| WO | WO 2005/045306 | 5/2005 |

*Primary Examiner* — Lars A Olson

(74) *Attorney, Agent, or Firm* — ExxonMobil Upstream Research-Law Department

(57) ABSTRACT

A mooring apparatus that includes an actuator connected to a mooring hook and the mooring base. The actuator provides translational movement of the mooring hook towards the mooring base. The mooring apparatus also includes a vessel motion detection system and a mooring apparatus control system. The mooring apparatus may include a mooring line tension gauge. The vessel motion detection system provides an input indicative of vessel motion to the mooring apparatus control system. The mooring apparatus control system then provides an output signal to the appropriate mooring system(s) which results in adjustment of the mooring line tension in the appropriate mooring system(s). Methods for use thereof are also disclosed.

19 Claims, 4 Drawing Sheets

(56) References Cited

U.S. PATENT DOCUMENTS 7,293,519 B2 11/2007 Montgomery et al.
7,536,970 B1 * 5/2009 McCoy et al. ..... 294/82.27
7,543,543 B2 6/2009 Boatman et al.
2006/0156744 A1 7/2006 Cusiter et al.
2010/0272517 A1 10/2010 Montgomery

* cited by examiner

LOAD COMPENSATING MOORING HOOKS

CROSS-REFERENCE TO RELATED APPLICATION

This application is the National Stage of International Application No. PCT/US2013/021238, filed 11 Jan. 2013, which claims the priority benefit of U.S. Provisional Patent Application 61/592,928, filed 31 Jan. 2012 entitled LOAD COMPENSATING MOORING HOOKS, the entirety of which is incorporated by reference herein.

FIELD OF THE INVENTION

Embodiments of the present invention are directed toward mooring systems for vessels, and more specifically, towards mooring systems that compensate for motion of the moored vessel and/or in response to the load or tension on the ropes, mooring lines, and/or hawsers connected to the vessel.

BACKGROUND

This section is intended to introduce various aspects of the art, which may be associated with exemplary embodiments of the present techniques. This discussion is believed to assist in providing a framework to facilitate a better understanding of particular aspects of the present techniques. Accordingly, it should be understood that this section should be read in this light, and not necessarily as admissions of prior art.

Mooring systems for marine vessels have not changed in principle since the early days of sail. A vessel is moored when it is fastened to a fixed object such as a bollard, pier, terminal, quay or the seabed, or to a floating object such as an anchor buoy. Mooring is often accomplished using thick ropes called mooring lines or hawsers. The lines may be constructed of fiber, natural or synthetic, or metal wire, or a combination of both wire and fiber. The lines are fixed to deck fittings on the vessel at one end, and fittings on the shore, such as bollards, rings, or cleats, on the other end. Once the lines are passed between the vessel and mooring hooks mounted on the pier or shore, they are heaved tight. On large ships, this tightening can be accomplished with the help of heavy machinery called mooring winches or capstans. For the heaviest cargo ships, more than a dozen mooring lines can be required.

As noted above, mooring lines are usually made out of synthetic materials such as nylon. Nylon has a property of being elastic. This elasticity has its advantages and disadvantages. The main advantage is that during an event, such as a high wind or the close passing of another ship, excess stress can be spread among several lines. On the other hand, if a highly-stressed nylon line does break, or part, it causes a very dangerous phenomenon called "snapback" which can cause fatal injuries.

Typical mooring systems work well when forces are relatively small and/or constant in force and direction. When the forces are varied, the vessel starts to sway and surge on its moorings. When the forces are large or their frequency approaches the natural frequency of the mooring system, the vessel can move enough to render brakes (i.e. exceed the capacity of the brakes on the mooring line winches on the vessel) or part the mooring lines.

Existing vessel-mooring systems manage these wave load issues in several ways:

Limiting the size of waves (and thus wave loads) that the vessel-mooring system can be exposed to. This is a minor issue for terminals in protected waters, such as harbors, but can have a significant effect on the ability to moor a vessel at an offshore terminal, such as the Adriatic LNG terminal.

Increasing the size and number of mooring lines. This makes the system stronger and able to work in larger waves, at a cost. There is still a wave limit, for example in long period waves, such as those longer than 10 seconds, ships can only be moored in wave heights of one meter or less. Most vessels are limited in the number of mooring lines they can handle.

Adjusting the stiffness of the mooring lines. Adding stretchable tails to the mooring lines changes the stiffness of the system, which in turn changes the natural period, which in turn changes the extent of resonance and dynamic amplification. At least one company has proposed the addition of mechanical springs. While these systems reduce the chance of a line breaking they can result in even more pronounced surge motions.

With the presently available technologies, vessel-mooring systems can reach their limits when the swell has a significant wave height of about one meter.

The need still exists for new approaches to the mooring of a vessel. In particular, there is a need for new approaches due to unsafe conditions created when wave heights increase beyond one meter, which is frequently encountered at offshore terminals.

SUMMARY OF INVENTION

Embodiments herein relate to a mooring apparatus that includes an actuator connected to a mooring hook and the mooring base. The actuator provides translational movement of the mooring hook towards the mooring base. The mooring apparatus also includes a vessel motion detection system and a mooring apparatus control system. The mooring apparatus may include a mooring line tension gauge. The vessel motion detection system provides an input indicative of vessel motion to the mooring apparatus control system. The mooring apparatus control system then provides an output signal to the appropriate mooring system(s) which results in adjustment of the mooring line tension in the appropriate mooring system(s).

Embodiments herein relate to a method of controlling a mooring system which includes mooring a vessel to a terminal using one or more mooring lines and one or more mooring hooks connected to a terminal. A vessel motion detection system detects motion of the vessel and provides a signal to a mooring control system which can control the movement of the mooring hooks of the mooring system. The mooring control system can then let out or retract the appropriate mooring hooks in response to the input from the vessel motion detection system to oppose the detected motion of the vessel. The vessel motion detection system can provide a signal to the mooring control system which is indicative of vessel direction, rotation, speed, and/or acceleration. The mooring control system can also determine which mooring lines may be aiding the detected direction of the motion of the vessel and decrease the tension in those lines by letting out the appropriate mooring hooks. Embodiments herein also may include a mooring line tension system which provides a signal to the mooring control system. The mooring control system may control the mooring hooks such that mooring line tension is minimized or optimized. The mooring control system may therefore provide a method of avoiding excessive mooring line tension and damaging mooring lines or mooring equipment and provide a safer work environment. The mooring control system may also minimize motion of a vessel alongside a terminal and keep the vessel-based manifold system in approximate alignment with the terminal's unloading or loading facilities. Thus, the mooring control system may allow safer and continued operations in conditions that were previously unsafe or prevented unloading or loading operations.

Methods for use thereof and methods of manufacture thereof are also disclosed.

BRIEF DESCRIPTION OF THE DRAWINGS

The foregoing and other advantages of the present techniques may become apparent upon reviewing the following detailed description and drawings of non-limiting examples of embodiments in which.

DETAILED DESCRIPTION

Figure 1:
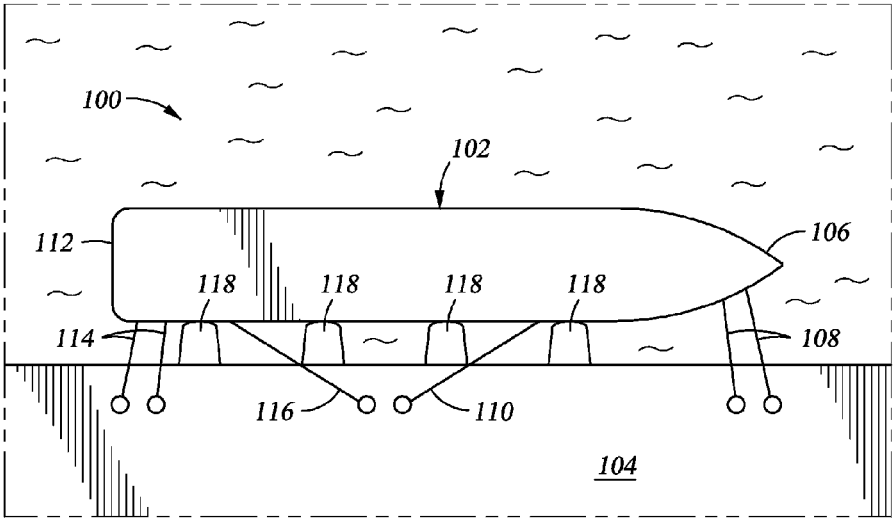
FIG. 1 is an exemplary illustration of a mooring arrangement for a vessel.

In the following detailed description section, the specific embodiments of the present techniques are described in connection with preferred embodiments. However, to the extent that the following description is specific to a particular embodiment or a particular use of the present techniques, this is intended to be for exemplary purposes only and simply provides a description of the exemplary embodiments. Accordingly, the invention is not limited to the specific embodiments described below, but rather, it includes all alternatives, modifications, and equivalents falling within the true spirit and scope of the appended claims.

As used herein, "control system" typically comprises one or more physical system components employing logic circuits that cooperate to achieve a set of common process results. In an operation of a load-compensation mooring system, the objectives can be to maintain a particular vessel location and optimize line mooring line tension during challenging weather conditions. The control system can be designed to reliably control the physical system components in the presence of external disturbances, variations among physical components due to manufacturing tolerances, and changes in inputted set-point values for controlled output values. Control systems usually have at least one measuring device, which provides a reading of a process variable, which can be fed to a controller, which then can provide a control signal to an actuator, which then drives a final control element acting on, for example, a mooring hook or the base of a mooring hook system. The control system can be designed to remain stable and avoid oscillations within a range of specific operating conditions. A well-designed control system can significantly reduce the need for human intervention, even during upset conditions in an operating process.

Embodiments herein relate to a mooring apparatus that includes an actuator connected to a mooring hook and the mooring base. The actuator provides translational movement of the mooring hook away from and towards the mooring base. The mooring apparatus also includes a vessel motion detection system and a mooring apparatus control system. The mooring apparatus may include a mooring line tension gauge. The vessel motion detection system provides an input indicative of vessel motion to the mooring apparatus control system. The mooring apparatus control system then provides an output signal to the appropriate mooring system(s) which results in adjustment of the mooring line tension in the appropriate mooring system(s).

Embodiments herein relate to a method of controlling a mooring system which includes mooring a vessel to a terminal using one or more mooring lines and one or more mooring hooks connected to a terminal. A vessel motion detection system detects motion of the vessel and provides a signal to a mooring control system which can control the movement of the mooring hooks of the mooring system. The mooring control system can then let out or retract the appropriate mooring hooks in response to the input from the vessel motion detection system to oppose the detected motion of the vessel. The vessel motion detection system can provide a signal to the mooring control system which is indicative of vessel direction, rotation, speed, and/or acceleration. The mooring control system can also determine which mooring lines may be aiding the detected direction of the motion of the vessel and decrease the tension in those lines by letting out the appropriate mooring hooks. Embodiments herein also may include a mooring line tension system which provides a signal to the mooring control system. The mooring control system may control the mooring hooks such that mooring line tension is minimized or optimized. The mooring control system may therefore provide a method of avoiding excessive mooring line tension and damaging mooring lines or mooring equipment and provide a safer work environment. The mooring control system may be designed to act dynamically to alter the natural period of the moored vessel, thus reducing the likelihood of resonant response and dynamic amplification of loads in the mooring lines. The mooring control system may also minimize motion of a vessel alongside a terminal and keep the vessel based manifold system in approximate alignment with the terminal's unloading or loading facilities. Thus, the mooring control system may allow safer and continued operations in conditions that were previously unsafe or prevented unloading or loading operations.

Referring to FIG. 1, illustrated is an exemplary arrangement 100 of mooring a vessel 102 to a pier or terminal 104. In the illustrated embodiment, the bow 106 of the vessel 102 is connected to the terminal 104 by bow or head mooring lines 108 and a forward or bow spring line 110. The bow or head mooring lines 108 may be a combination of bow lines and forward breast lines. Although not illustrated, as mentioned previously, each line may consist of multiple lines or ropes. Similarly, the stern 112 of the vessel 102 is connected to the terminal 104 by stern mooring lines 114 and a stern spring line 116. The stern mooring lines 114 may be a combination of stern lines and aft breast lines. The lines are pulled taught and pull the side of the vessel 102 against fenders 118.

Figure 2:
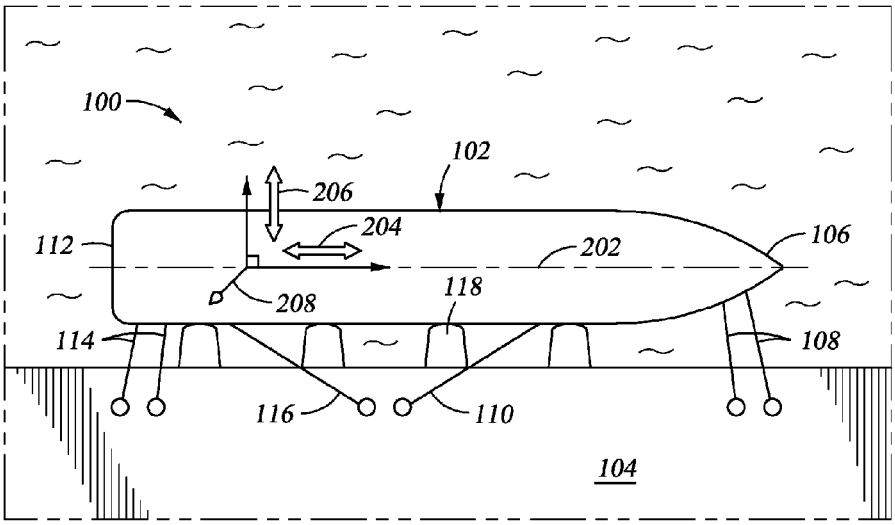
FIG. 2 is an illustration of the translational movement of the moored vessel of FIG. 1.

Referring to FIG. 2, a vessel-mooring system may be characterized as a six degree-of-freedom system. The vessel 102 experiences translational movements called surge 204 in the direction of its longitudinal axis 202 and movements called sway 206 that are transverse to the vessel's longitudinal axis. Additionally, the vessel experiences a translational movement called heave 208 in the vertical direction transverse to the surge and sway directions. Traditional rotational movements of yaw, pitch and roll are also present for a vessel. Usually, the more important degrees of freedom for mooring design are surge (along the axis of the vessel) and sway (transverse to the long axis of the vessel). In the discussion that follows, sway will be used to exemplify the issues to be addressed by the invention. However, the invention addresses all important degrees of freedom.

Sway motions of a vessel and loads in its mooring lines are affected by wind, wave, and current acting on the vessel. Wind and current loads are essentially static. Wave loads, however, act at many frequencies and the wave loads that are near the natural period of the vessel-mooring system in sway can cause dynamic response, including resonance and amplification. The mooring lines which have some degree of elasticity act provide a spring-like effect in the mooring system. The six degree of freedom vessel-mooring system can be considered a lightly damped, spring mass system that will have natural resonance and amplification frequencies. Wave loads at resonance with the surge period can lead to excessive mooring line loads that may damage or break mooring lines and other mooring equipment and result in large vessel motions. One-time, or impulsive, wave loads can be amplified when they occur with a rise time that relates to the natural period of the vessel-mooring system.

Figure 3:
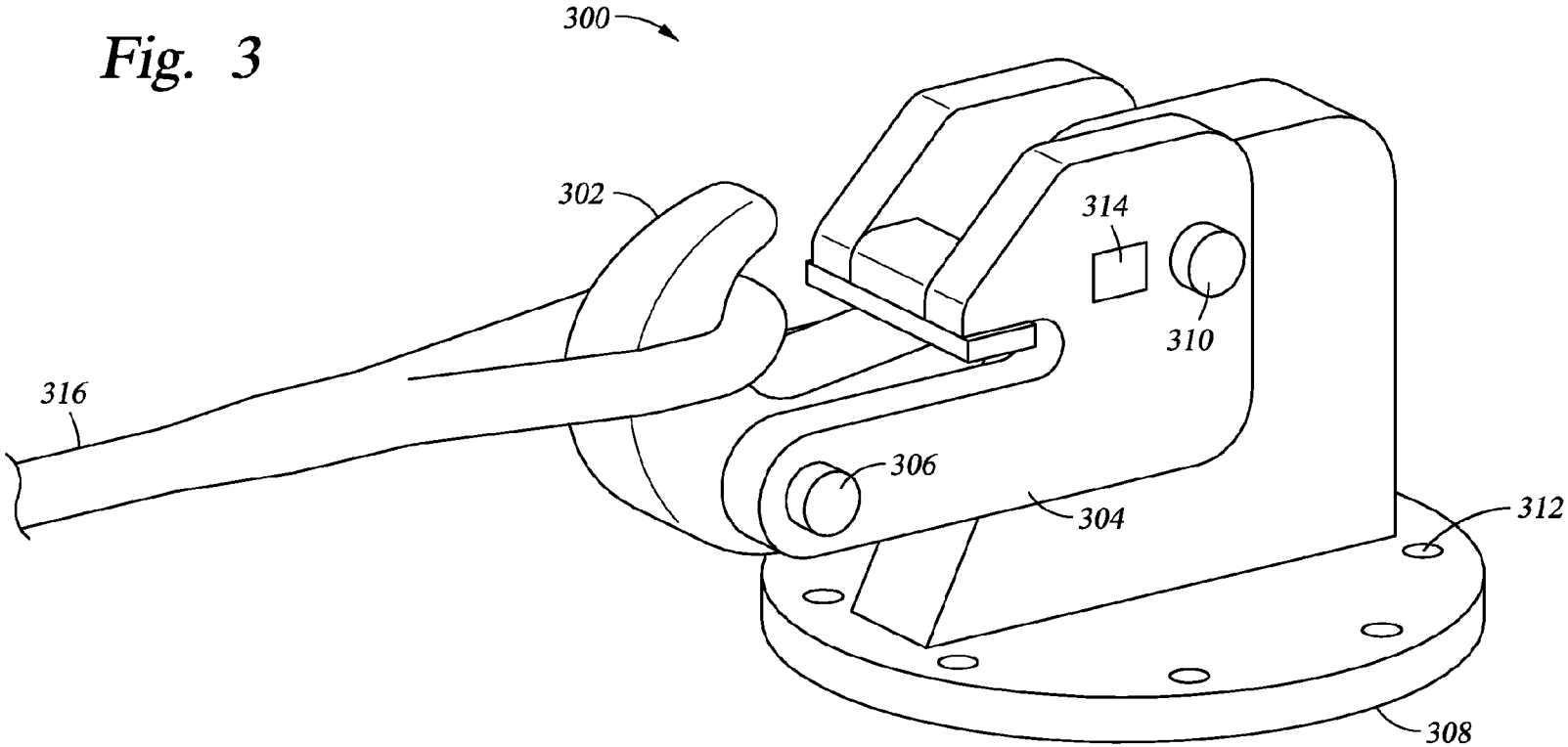
FIG. 3 is an view of an exemplary mooring hook.

Referring to FIG. 3, illustrated is an exemplary mooring hook system 300 known in the prior art. The mooring hook system 300 includes a hook 302 that is pivotably connected between two side plates 304 by the use of a hook pin 306. The two side plates 304 are pivotably connected to a base 308 by the use of a base pin 310. The base 308 may include bolt holes 312 to allow the mooring hook system 300 to be bolted to the pier or terminal. Mooring line load monitoring devices 314, such as, for example, a strain gauge, are provided in the mooring hook system 300 to provide a measurement of line tension in the mooring line 316. In some examples, a mooring hook system may include up to six different sets of hooks on a single base.

Figure 4:
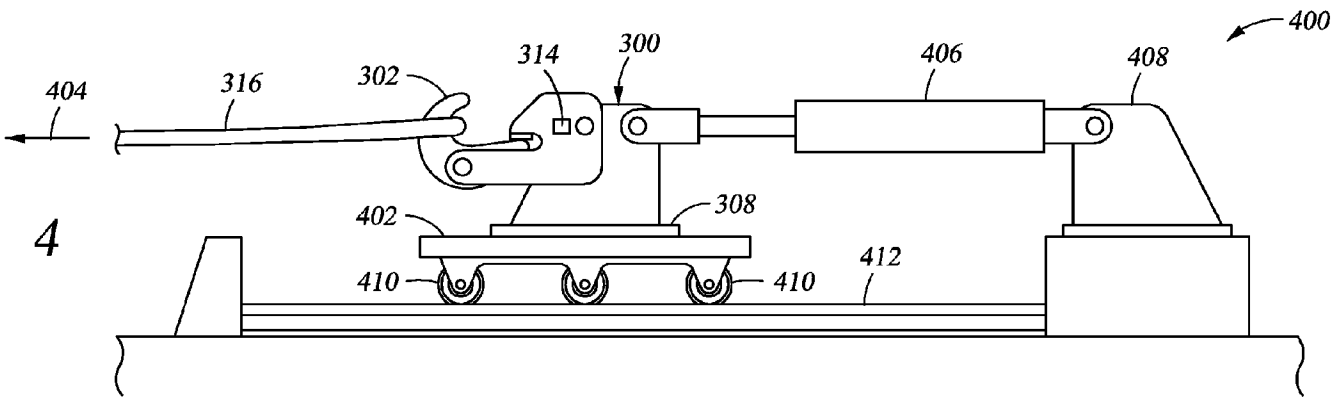
FIG. 4 is a side view of a load compensating mooring system according to an embodiment of the present invention.

Referring to FIG. 4, illustrated is a load compensating mooring hook system 400 according to an embodiment of the present invention. The load compensating mooring hook system 400 includes the mooring hook system 300 of FIG. 3 in which the base 308 is bolted to a moveable base 402 that can translate in the direction of the axis 404 of the mooring line 316.

In the illustrated embodiment of FIG. 4, the moveable base 402 is connected to an end of a hydraulic cylinder 406 that provides the translational movement of the moveable base 402. In turn, the opposite end of the hydraulic cylinder 406 is connected to a base 408, which is connected to the pier or terminal. In the illustrated embodiment, the moveable base 402 rides on rollers or wheels 410 on rails 412. Although a hydraulic cylinder is illustrated, other types of actuators would be within the scope of the invention, such as electric motors, winches, or other devices to enable a translational movement of the moveable base 402, and thus a translational movement of the hook 302 or mooring line 316. It would be within the scope of the invention to use other types of friction reducing surfaces or devices, rather than wheels or rollers, to enable the translational movement of the moveable base 402. Mooring line load monitoring devices 314, such as, for example, a strain gauge, are provided in the mooring hook system 300 to provide a measurement of line tension in the mooring line 316.

In the embodiment shown in FIG. 4 of the load compensating mooring hook system, existing mooring hook systems can be utilized by connecting the existing mooring hook systems to the moveable base of the load compensating mooring hook system. In some embodiments, the moveable base 402 may support one or several hooks 302.

The base 402 would move on the primary axis of the mooring lines that attach to the base. That is in the surge direction for spring lines, and in the sway direction for breast, head and stern lines.

Figure 5:
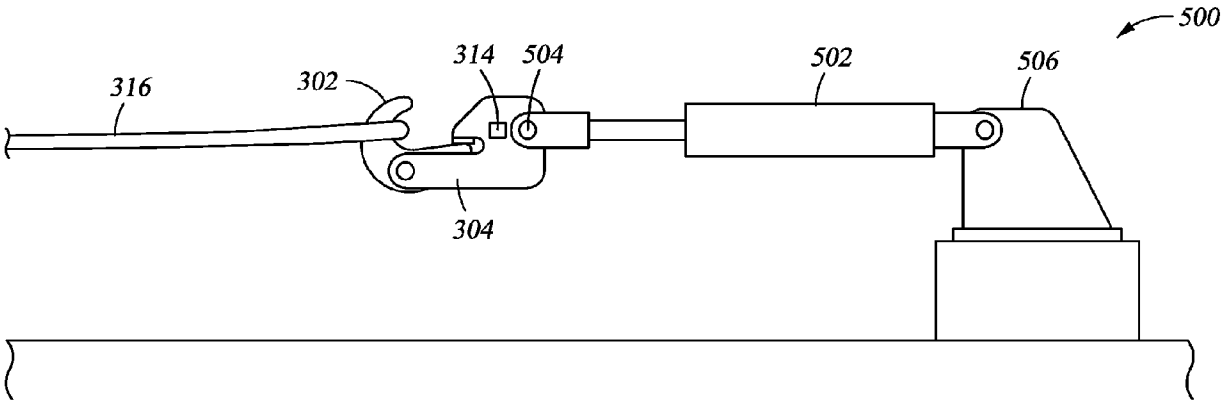
FIG. 5 is a side view of a load compensating mooring system according to an embodiment of the present invention.

Referring to FIG. 5, illustrated is an exemplary embodiment of a load compensating mooring hook system 500 according to an embodiment of the present invention. The load compensating mooring hook system 500 is similar to the mooring hook system 300 of FIG. 3 however the two side plates 304 are pivotably connected to a hydraulic cylinder 502 by the use of an actuator pin 504. The hydraulic cylinder 502 allows translational movement of the mooring hook 302 and the two side plates 304. The hydraulic cylinder 502 is connected to a base 506. In another embodiment, one end of the hydraulic cylinder is connected to the mooring hook 302, instead of the two side plates 304. In either embodiment, mooring line load monitoring devices 314, such as, for example, a strain gauge may be provided in the mooring hook system 300 to provide a measurement of line tension in the mooring line 316.

The embodiment of FIG. 5 would allow the control of individual mooring lines which may be desired, for example, when a mooring system contains mooring lines in various different directions on a single base. In comparison, the embodiment of FIG. 4 allows movement of the base in single direction and thus may be more suitable when all of the mooring hooks on the base are aligned in the same direction.

An embodiment of the control system for the load compensating mooring system will be based on the motion of the vessel, similar to a Dynamic Positioning (DP) system. Primary input would come from vessel position tracking equipment such as MDL's Fanbeam® system. When motion of the vessel is detected, the appropriate mooring base will be driven to quickly increase the mooring line tension. As the movement of the vessel is slowed by the increased mooring line tension, the direction of the driven mooring base may be changed to decrease mooring line tension and to minimize spring back of the vessel. The computer will drive the mooring base to softly return the vessel to its original position, not exceed the recommended limits on mooring line tension, and minimize overshoot of the vessel.

For example, the breast hooks can be adjusted to compensate for external forces and maintain contact with the fenders while reducing fender compression and spring off. When motion of the vessel is detected towards the fenders the moorings would be rendered, i.e., let out to reduce the mooring breast line tension. Conversely, motion away from the fenders will cause the motion bases to be driven to quickly increase mooring breast line tension. The control system will control the bases to softly maintain the vessel on the fenders.

In some embodiments, the mooring control system may be designed to actuate the load compensating mooring system dynamically in order to alter the natural period of the moored vessel. For example, continuous changing of the mooring system stiffness reduces the magnitude of resonant response and dynamic amplification of loads in the mooring lines.

Figure 6:
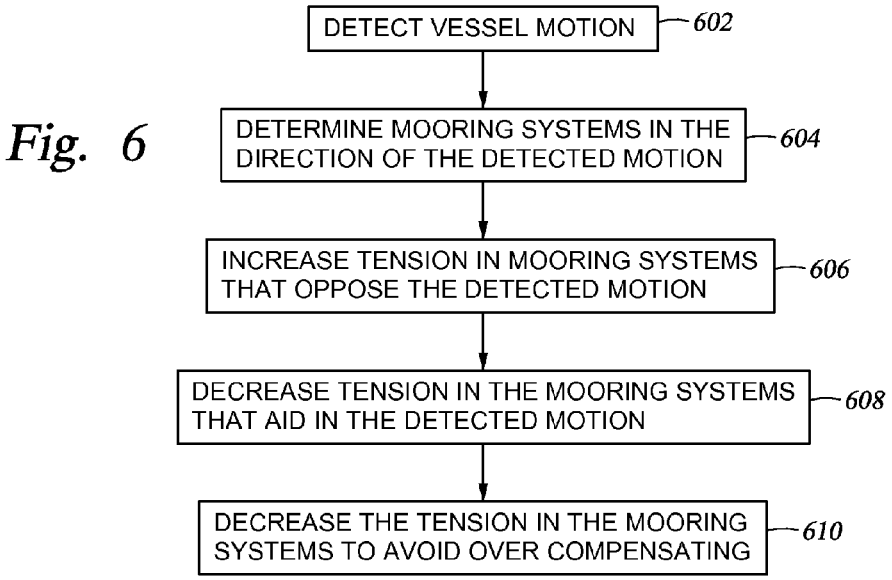
FIG. 6 is an exemplary method of operation of a load compensating mooring system according to an embodiment of the present invention.

Referring to FIG. 6, illustrated is a method 600 of operating a load compensating mooring system. In step 602, motion of a vessel is detected. The motion detection system may provide the direction, speed and/or acceleration of the detected motion of the vessel. In step 604, it is determined which mooring lines and/or which mooring systems are in the direction of the motion of the vessel. For example, if the motion of the vessel is in ahead surge direction—in the ahead direction of the longitudinal axis of the vessel—then the bow spring mooring line and stern spring mooring lines are in the direction of the motion of the vessel. More specifically, the bow spring mooring line would oppose the ahead surge of the vessel and the stern spring mooring line would aid the ahead surge of the vessel. As another example, if the vessel is swaying away from the terminal, then the breast lines are in the direction of the motion of the vessel and would oppose the sway of the vessel. If the motion of the vessel is a combination of surge and sway, such as in a diagonal direction away from the terminal, then a combination of breast and spring lines are in the direction of the motion of the vessel and the combination may be needed to oppose the motion of the vessel. If the motion of the vessel is a rotation, such as yaw in which the bow of the boat is rotating away from the terminal, the bow breast lines may oppose the rotation of the bow away from the terminal and the stern breast lines may increase the rotation of the stern towards the terminal.

In step 606, the tension in the appropriate mooring lines that oppose the detected motion of the vessel from step 604 is increased by a retraction of the appropriate load compensating mooring system. In optional step 608, the tension in the appropriate mooring lines that aid, i.e. are pulling in the motion of the vessel from step 604 is decreased by letting out the appropriate load compensating mooring system. In step 610, the tension in the retracted mooring lines may be decreased to avoid over-compensating or having a spring-back effect by the vessel. Step 610 may require the measurement of the mooring line tension, detection of a change in the vessel's motion in response to the retraction of the mooring system, such as a deceleration of the vessel's motion, or a combination of both. In an embodiment, the retraction of the mooring lines in step 606 may be controlled to minimize any spikes in tension of the lines.

The control logic will include controls to limit overload of mooring lines to the extent possible, up to the limit of motion of the base. The load compensating mooring system may have a locking mechanism to facilitate personnel working the mooring lines and also to save energy when conditions are benign and load compensating mooring system is not required. The load compensating mooring system may allow a vessel to safely maintain position alongside a terminal in 2 to 3 meter significant wave height, or approximately 2 to 3 times the present limit. It should also result in fewer broken lines and increase the safety of personnel working near mooring lines.

Figure 7:
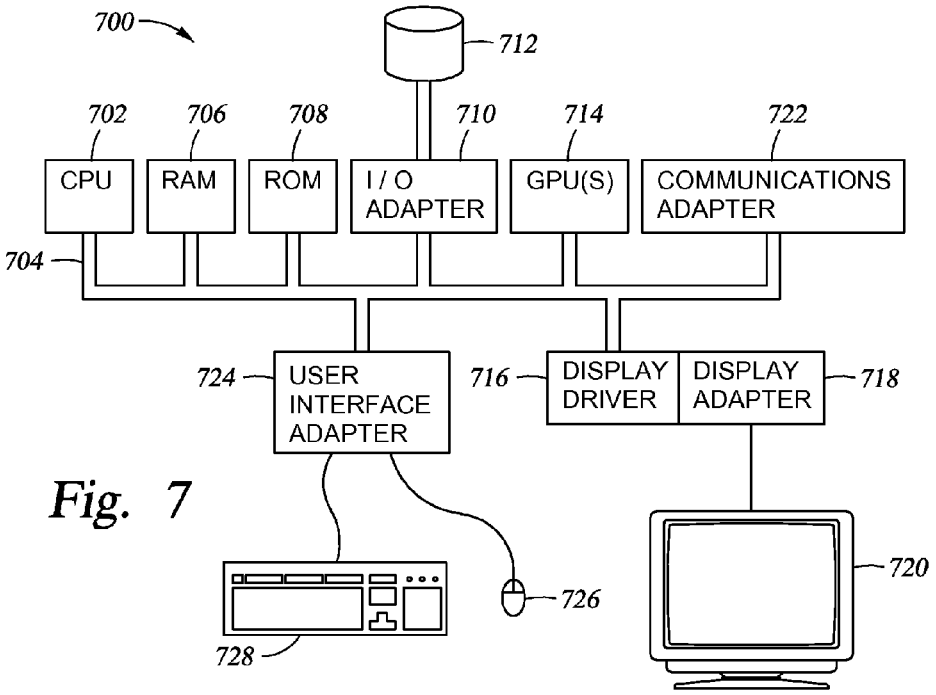
FIG. 7 is a block diagram of a computer system that may be used to perform a method for operating load compensating mooring system according to exemplary embodiments of the present techniques.

FIG. 7 is a block diagram of a computer system that may be used to perform a method of controlling a load compensating mooring system according to exemplary embodiments of the present techniques. The computer system is generally referred to by the reference number 700. A central processing unit (CPU) 702 is coupled to system bus 704. The CPU 702 may be any general-purpose CPU, although other types of architectures of CPU 702 (or other components of exemplary system 700) may be used as long as CPU 702 (and other components of system 700) supports the inventive operations as described herein. Those of ordinary skill in the art will appreciate that, while only a single CPU 702 is shown in FIG. 7, additional CPUs may be present. Moreover, the computer system 700 may comprise a networked, multi-processor computer system. The CPU 702 may execute the various logical instructions according to various exemplary embodiments. For example, the CPU 702 may execute machine-level instructions for performing processing according to the operational flow described above in conjunction with FIG. 6.

The computer system 700 may also include computer components such as computer-readable storage media. Examples of computer-readable storage media include a random access memory (RAM) 706, which may be SRAM, DRAM, SDRAM, or the like. The computer system 700 may also include additional computer-readable storage media such as a read-only memory (ROM) 708, which may be PROM, EPROM, EEPROM, or the like. RAM 706 and ROM 708 hold user and system data and programs, as is known in the art. The computer system 700 may also include an input/output (I/O) adapter 710, a communications adapter 722, a user interface adapter 724, and a display adapter 718.

The I/O adapter 710 preferably connects a storage device(s) 712, such as one or more of hard drive, compact disc (CD) drive, floppy disk drive, tape drive, etc. to computer system 700. The storage device(s) may be used when RAM 706 is insufficient for the memory requirements associated with storing data for operations of embodiments of the present techniques. The data storage of the computer system 700 may be used for storing information and/or other data used or generated as disclosed herein.

The computer system 700 may comprise one or more graphics processing units (GPU(s)) 714 to perform graphics processing. Moreover, the GPU(s) 714 may be adapted to provide a visualization useful in monitoring vessel motions and mooring line tensions according to the present techniques. The GPU(s) 714 may communicate via a display driver 716 with a display adapter 718. The display adapter 718 may produce a visualization on a display device 720. Moreover, the display device 720 may be used to display information or a representation pertaining to a mooring line tension, mooring system movement, vessel motion data including direction, speed, acceleration, etc., according to certain exemplary embodiments. Moreover, an exemplary embodiment of the display adapter 718 may comprise a visualization engine that is adapted to provide a visualization of such communication data. The I/O adapter 710, the user interface adapter 724, and/or communications adapter 722 may, in certain embodiments, enable a user to interact with computer system 700 in order to input information.

A user interface adapter 724 may be used to couple user input devices. For example, the user interface adapter 724 may connect devices such as a pointing device 726, a keyboard 728, and/or output devices to the computer system 700.

The architecture of system 700 may be varied as desired. For example, any suitable processor-based device may be used, including without limitation personal computers, laptop computers, computer workstations, and multi-processor servers. Moreover, embodiments may be implemented on application specific integrated circuits (ASICs) or very large scale integrated (VLSI) circuits. In fact, persons of ordinary skill in the art may use any number of suitable structures capable of executing logical operations according to the embodiments.

While the present techniques of the invention may be susceptible to various modifications and alternative forms, the exemplary embodiments discussed above have been shown by way of example. However, it should again be understood that the invention is not intended to be limited to the particular embodiments disclosed herein. Indeed, the present techniques of the invention are to cover all modifications, equivalents, and alternatives falling within the spirit and scope of the invention as defined by the following appended claims.

What is claimed is:

1. A method of controlling a mooring system comprising:

mooring a vessel to a terminal using one or more mooring lines;

providing a vessel motion detection system;

providing a mooring control system operatively connected to the one or more mooring lines and operatively connected to the vessel motion detection system;

determining vessel motion data which comprises determining one or more of vessel direction, speed and acceleration;

determining which of the one or more mooring lines oppose the direction of the motion of the vessel; and operating at least one of the one or more mooring lines by the mooring control system based on the vessel motion data, the mooring control system configured to control translational movement of one or more mooring hooks of the mooring system, wherein the one or more mooring lines that oppose the direction of the motion of the vessel are retracted at least in part by translational movement of the associated one or more mooring hooks to oppose the detected motion of the vessel.

2. The method of claim 1, further comprising measuring the tension in the one or more mooring lines and retracting or rendering the one or more mooring hooks to not exceed a predetermined tension.

3. The method of claim 2, further comprising determining which of the one or more mooring lines aid in the movement of the vessel and decreasing the tension in the mooring hooks which aid in movement of the vessel.

4. The method of claim 1, wherein the operating at least one of the one or more mooring lines by the mooring control system dynamically alters the natural period of the moored vessel to reduce the magnitude of resonant response and dynamic amplification of loads in the mooring lines.

5. The method of claim 1, further comprising changing the direction of the translational movement of the associated one or more mooring hooks to decrease mooring line tension to minimize spring back of the vessel.

6. The method of claim 5, wherein the direction change of the translational movement of the associated one or more mooring hooks is in response to deceleration of the motion of the vessel provided by the vessel motion detection system.

7. A mooring apparatus comprising:

one or more mooring hooks for connecting one or more mooring lines, a mooring base;

an actuator operatively connected to each of the one or more mooring hooks and the associated mooring base, wherein the actuator provides translational movement of the mooring hook towards the mooring base;

a vessel motion detection system for determining vessel motion data, the vessel motion data comprising one or more of vessel direction, speed and acceleration; and a mooring apparatus control system operatively connected to each actuator and operatively connected to the vessel motion detection system to control translational movement of the one or more mooring hooks in response to input from the vessel motion detection system, wherein mooring hooks connected to mooring lines which oppose the direction of the motion of the vessel are retracted by the mooring apparatus control system to oppose detected motion of the vessel.

8. The mooring apparatus of claim 7, wherein the vessel motion detection system is an optical based motion detection system.

9. The mooring apparatus of claim 7, further comprising a mooring line tension gauge.

10. The mooring apparatus of claim 7, wherein the vessel motion data includes rotation of the vessel.

11. The mooring apparatus of claim 7, wherein the actuator is selected from a hydraulic cylinder, an electric motor, and a winch.

12. The mooring apparatus of claim 7, wherein the actuator is a hydraulic cylinder.

13. The mooring apparatus of claim 12, further comprising a moveable base operatively connected to an end of the hydraulic cylinder with another end of the hydraulic cylinder operatively connected to the mooring base.

14. The mooring apparatus of claim 13, wherein the moveable base includes rollers or wheels positioned on rails.

15. A method of controlling a mooring system comprising:

means for mooring a vessel to a terminal using one or more mooring lines;

means for providing a vessel motion detection system;

means for providing a mooring control system operatively connected to the one or more mooring lines and operatively connected to the vessel motion detection system;

means for determining vessel motion data, the vessel motion data comprising one or more of vessel direction, speed and acceleration;

means for determining which of the one or more mooring lines oppose the direction of the motion of the vessel; and means for operating at least one of the one or more mooring lines by the mooring control system based on the vessel motion data, the mooring control system configured to control translational movement of one or more mooring hooks of the mooring system, wherein the one or more mooring lines that oppose the direction of the motion of the vessel are retracted at least in part by translational movement of the associated one or more mooring hooks to oppose the detected motion of the vessel.

16. The method of claim 15, further comprising means for measuring the tension in the one or more mooring lines and retracting or rendering the one or more mooring hooks to not exceed a predetermined tension.

17. The method of claim 16, further comprising means for determining which of the one or more mooring lines aid in the movement of the vessel and decreasing the tension in the mooring hooks which aid in movement of the vessel.

18. The method of claim 15, further comprising means for changing the direction of the translational movement of the associated one or more mooring hooks to decrease mooring line tension to minimize spring back of the vessel.

19. The method of claim 18, wherein the direction change of the translational movement of the associated one or more mooring hooks is in response to deceleration of the motion of the vessel provided by the vessel motion detection system.

* * * * *